US008023857B2

(12) United States Patent
Saka

(10) Patent No.: US 8,023,857 B2
(45) Date of Patent: Sep. 20, 2011

(54) TRANSFER DEVICE AND IMAGE FORMING APPARATUS WITH SEALING MEMBER IN CONTACT WITH TRANSFER BELT

(75) Inventor: Yoshihisa Saka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 367 days.

(21) Appl. No.: 12/365,757

(22) Filed: Feb. 4, 2009

(65) Prior Publication Data

US 2009/0208240 A1 Aug. 20, 2009

(30) Foreign Application Priority Data

Feb. 15, 2008 (JP) ..... 2008-034551
Oct. 6, 2008 (JP) ..... 2008-259374

(51) Int. Cl.
*G03G 15/16* (2006.01)

(52) U.S. Cl. ..... 399/101; 399/102; 399/348; 399/351

(58) Field of Classification Search ..... 399/101, 399/102, 348, 351
See application file for complete search history.

(56) References Cited

U.S. PATENT DOCUMENTS

2003/0099480 A1* 5/2003 Nishimura et al. ..... 399/102
2007/0201897 A1* 8/2007 Maeda et al. ..... 399/101
2007/0286654 A1* 12/2007 Kawagoe ..... 399/353
2008/0038012 A1* 2/2008 Horrall et al. ..... 399/101

FOREIGN PATENT DOCUMENTS

JP 2005-338734 12/2005
JP 2006030491 A * 2/2006
JP 2006-071836 3/2006
JP 2007101989 A * 4/2007

OTHER PUBLICATIONS

JP 2006030491 A, English Abstract to Tomiya et al.*
JP 2007101989 A, English Abstract to Maeda et al.*

* cited by examiner

*Primary Examiner* — Ryan Walsh
(74) *Attorney, Agent, or Firm* — DLA Piper LLP (US)

(57) ABSTRACT

A transfer device includes: a transfer belt hung around a roller; and a transfer belt sealing member in contact with a transfer surface and a circumferential end surface of the transfer belt and in contact with the circumferential end surface of the transfer belt diagonally relative to a thickness direction of the transfer belt.

11 Claims, 9 Drawing Sheets

TRANSFER DEVICE AND IMAGE FORMING APPARATUS WITH SEALING MEMBER IN CONTACT WITH TRANSFER BELT

BACKGROUND

1. Technical Field

The present invention relates to a transfer device by which liquid developer images are transferred and an image forming apparatus.

2. Related Art

A variety of wet-process image forming apparatuses using a high-viscosity liquid developer in which toner particles of solid components are dispersed in a liquid solvent to develop an electrostatic latent image for visualizing the electrostatic latent image have been proposed. The liquid developer used in the wet-process image forming apparatuses contains liquid carrier of an electrically insulating organic solvent (carrier) such as silicone oil, mineral oil, vegetable oil and solid components (toner particles) dispersed therein. The toner particles are extremely fine, having particle diameters around 1 μm. Using such fine toner particles, the image quality can be made higher in the wet-process image forming apparatuses than in dry-process image forming apparatuses using powder toner particles having particle diameters of about 7 μm. In the image forming apparatus using the liquid developer, an image forming apparatus including a transfer device that transfers liquid developer images on image carriers onto a transfer belt is proposed (for example, see JP-A-2006-71836). In the image forming apparatus using the liquid developer, an image forming apparatus including a transfer unit that transfers liquid developer images that have been transferred onto an image carrier belt onto a transfer material such as paper is proposed (for example, see JP-A-2005-338734). In the transfer device used in the image forming apparatus disclosed in JP-A-2006-71836, a cleaning blade is brought into contact with the transfer belt after transfer to scrape and remove the residual toner and carrier.

However, the liquid developer scraped by the cleaning blade flows along the cleaning blade surface and is collected and the liquid developer accumulated in the contact part between the cleaning blade and the transfer belt surface spreads to the ends of the cleaning blade due to capillary action, and thus, a problem that a band of liquid called a liquid ring is generated and causes image defects such as color contamination and a problem that the liquid developer runs around to the rear side of the transfer belt and the transfer belt slips and unstably drives arise. When sealing members for transfer belt are provided in contact with the end surfaces of the transfer belt for preventing the liquid developer from running around to the rear side of the transfer belt, a problem that the leading end of the sealing member is entangled with the transfer belt due to friction and damaged arises.

SUMMARY

An advantage of some aspects of the invention is to provide a transfer device and an image forming apparatus by which the liquid developer is prevented from running around to the rear side of the transfer belt and the sealing members are prevented from being entangled with the transfer belt.

A transfer device according to an aspect of the invention includes: a transfer belt hung around a roller; and a transfer belt sealing member in contact with a transfer surface and a circumferential end surface of the transfer belt and in contact with the circumferential end surface of the transfer belt diagonally relative to a thickness direction of the transfer belt. The end of the transfer surface of the transfer belt can be cleaned because the transfer belt sealing member is in contact with the transfer surface and the circumferential end surface of the transfer belt. The transfer belt sealing member can be prevented from being entangled with the transfer belt and damaged due to friction because the member is in contact with the circumferential end surface of the transfer belt diagonally relative to the thickness direction of the transfer belt.

Further, according to the transfer device, the transfer belt sealing member is supported by a supporting member for urging in the thickness direction of the transfer belt. Since the transfer belt sealing member is supported by the supporting member and pressed against the transfer belt, the transfer belt sealing member bites into contact with the circumferential surface of the transfer belt and prevents the liquid developer and the like from running around to the rear side of the transfer belt.

Furthermore, according to the transfer device, an end surface of a contact part of the transfer belt sealing member with the transfer belt in a transport direction of the transfer belt is an inclined surface. Since the end surface of the transfer belt sealing member in the transport direction of the transfer belt is the inclined surface, the transfer belt sealing member is in contact with the circumferential end surface of the transfer belt diagonally relative to the thickness direction of the transfer belt, and the transfer belt sealing member is prevented from entangled with the intermediate transfer belt and damaged.

Additionally, according to the transfer belt, the transfer belt sealing member is a plate-like member, and a flat part of the transfer belt sealing member is brought into contact with the transfer surface of the transfer belt. Since the flat part of the plate-like transfer belt sealing member is brought into contact (surface contact) with the curved intermediate transfer belt hung around the roller, the transfer belt sealing member contacts the end surface of the intermediate transfer belt diagonally relative to the thickness direction of the transfer belt, and the transfer belt sealing member is prevented from entangled with the intermediate transfer belt and damaged.

Moreover, according to the transfer device, hardness H1 of the transfer belt and hardness H3 of the transfer belt sealing member has a relationship of H1>H3. The transfer belt sealing member can be in biting contact with the circumferential surface of the transfer belt by a small pressing force.

Further, the transfer device includes a transfer belt cleaning blade in contact with the roller via the transfer belt, and the transfer belt sealing member is provided at an axial end of the transfer belt cleaning blade. The liquid developer flowing from the end of the transfer belt cleaning blade is prevented from running around to the rear side of the transfer belt.

Furthermore, according to the transfer device, the supporting member supports the transfer belt cleaning blade. Since the transfer belt cleaning blade and the transfer belt sealing member are supported by the supporting member and pressed against the transfer belt, the cleaning effect of the transfer belt is improved, and the transfer belt sealing member bites into contact with the end surface of the transfer belt and prevents the liquid developer from running around to the rear side of the transfer belt.

In addition, according to the transfer device, a width L7 of the roller in an axial direction, a length L2 of the transfer belt cleaning blade in the axial direction of the roller, and a length L3 of the transfer belt sealing member in the axial direction of the roller have relationships of L7 >L2, L7<L2+2L3. The residual carrier and toner can be removed through ends of the transfer belt, and color contamination is prevented.

Moreover, an image forming apparatus according to another aspect of the invention includes: an image carrier; a developing unit that develops the image carrier with a liquid developer containing toner and carrier liquid; a transfer belt onto which an image oh the image carrier that has been developed by the developing unit is transferred; a transfer unit that transfers the image that has been transferred onto the transfer belt onto a transfer material; a roller around which the transfer belt is hung; a transfer belt cleaning blade in contact with the roller via the transfer belt; and a transfer belt sealing member provided at an end of the transfer belt cleaning blade in an axial direction of the roller, in contact with a transfer surface and a circumferential end surface of the transfer belt and in contact with the circumferential end surface of the transfer belt diagonally relative to a thickness direction of the transfer belt. The liquid developer flowing from the end of the transfer belt cleaning blade is prevented from running around to the rear side of the transfer belt and the end transfer surface of the transfer belt can be cleaned. The transfer belt sealing member can be prevented from being entangled with the transfer belt and damaged due to friction because the member is in contact with the circumferential end surface of the transfer belt diagonally relative to the thickness direction of the transfer belt.

Further, according to the image forming apparatus, the transfer belt cleaning blade and the transfer belt sealing member are supported by a supporting member for urging in a contact direction of the transfer belt. Since the transfer belt sealing member and the transfer belt sealing member are supported by the cleaning supporting member and pressed against the transfer belt, the cleaning effect of the transfer belt is improved, and the transfer belt sealing member bites into contact with the circumferential surface of the transfer belt and prevents the carrier and the like from running around to the rear side of the transfer belt.

Furthermore, according to the image forming apparatus, an end of a contact part of the transfer belt sealing member with the transfer surface of the transfer belt is an inclined surface. Since the end of the contact part of the transfer belt sealing member is the inclined surface, the transfer belt sealing member is in contact with the circumferential end surface of the transfer belt diagonally relative to the thickness direction of the transfer belt, and the transfer belt sealing member is prevented from entangled with the intermediate transfer belt and damaged.

In addition, according to the image forming apparatus, the transfer belt sealing member is a plate-like member, and a flat part of the transfer belt sealing member is brought into contact with the transfer surface of the transfer belt. Since the flat part of the plate-like transfer belt sealing member is brought into contact (surface contact) with the curved intermediate transfer belt hung around the roller, the transfer belt sealing member contacts the end surface of the intermediate transfer belt diagonally relative to the thickness direction of the transfer belt, and the transfer belt sealing member is prevented from entangled with the intermediate transfer belt and damaged.

Moreover, according to the image forming apparatus, a length L8 of the image carrier in the axial direction of the roller, a width L7 of the roller in the axial direction, a length L2 of the transfer belt cleaning blade in the axial direction, a length L3 of the transfer belt sealing member in the axial direction of the roller, provided at an end of the transfer belt cleaning blade in the axial direction have relationships of L8>L7, L7>L2, L7<L2+2L3. Since L8>L7, cleaning of the end of the transfer belt is necessary. The transfer belt sealing member cleans the end of the transfer belt and prevents the carrier from running around to the rear side of the transfer belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings.

Figure 1:
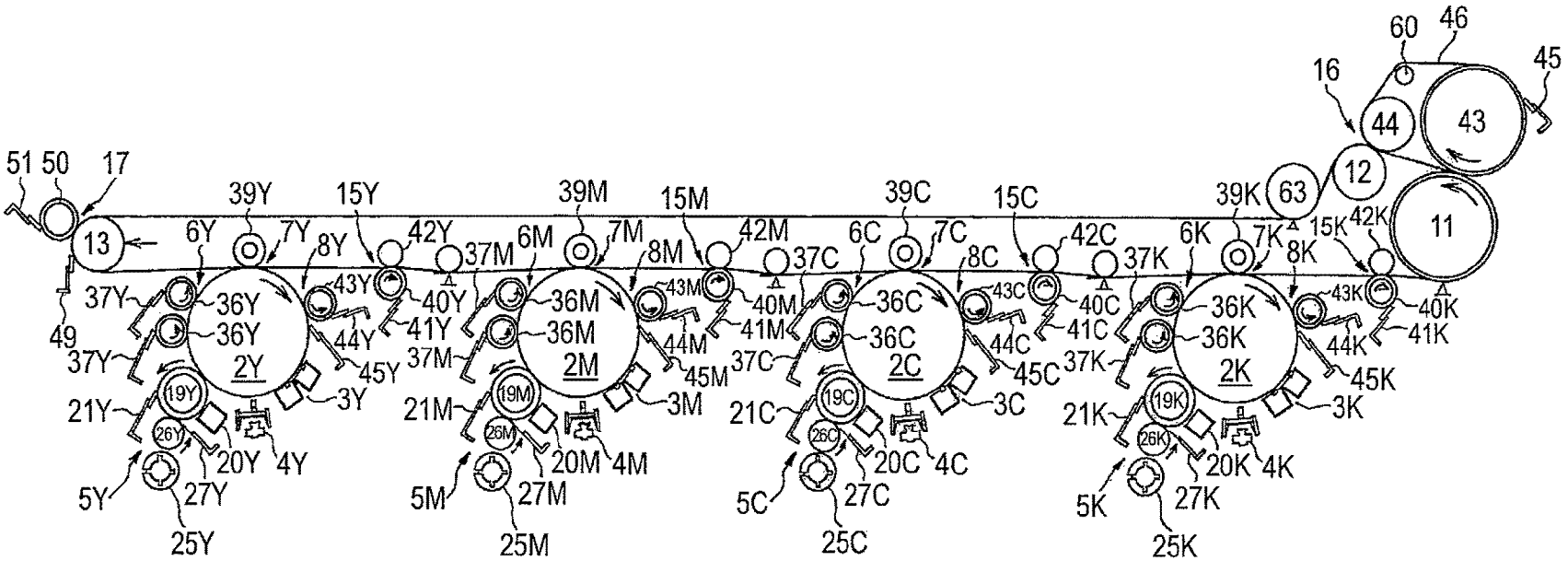
FIG. 1 shows an embodiment of the invention.

FIG. 1 schematically and partially shows an example of an embodiment of an image forming apparatus including a transfer device according to the invention.

As shown in FIG. 1, the image forming apparatus in this example includes photoconductors 2Y, 2M, 2C, 2K as latent image carriers of yellow (Y), magenta (M), cyan (C), black (K) in tandem arrangement. Here, in the respective photoconductors 2Y, 2M, 2C, and 2K, 2Y shows a yellow photoconductor, 2M shows a magenta photoconductor, 2C shows a cyan photoconductor, and 2K shows a black photoconductor. Further, for other members, Y, M, C, K representing the respective colors are added to signs of the members and similarly show members of the respective colors. All of the respective photoconductors 2Y, 2M, 2C, 2K are photoconductor drums in the example shown in FIG. 1. The respective photoconductors 2Y, 2M, 2C, 2K may be endless belts.

These photoconductors 2Y, 2M, 2C, 2K are adapted to rotate clockwise as indicated by arrows in FIG. 1 in operation. Around the respective photoconductors 2Y, 2M, 2C, 2K, charging members 3Y, 3M, 3C, 3K, exposure devices 4Y, 4M, 4C, 4K, developing devices 5Y, 5M, 5C, 5K, photoconductor squeeze devices 6Y, 6M, 6C, 6K, primary transfer devices 7Y, 7M, 7C, 7K, and photoconductor cleaning devices 8Y, 8M, 8C, 8K are provided sequentially from the upstream side in the rotational direction of them.

Figure 2:
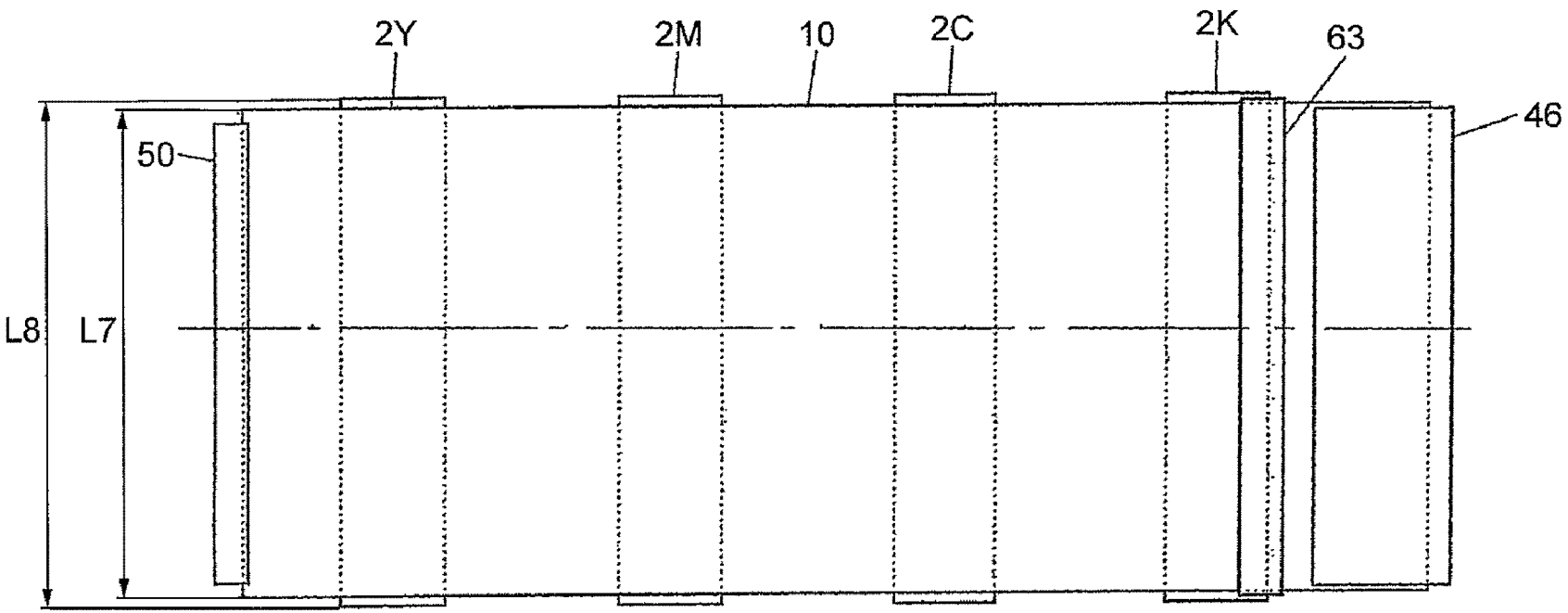
FIG. 2 shows the embodiment of the invention.

Further, the image forming apparatus 1 includes an endless intermediate transfer belt 10 as an intermediate transfer medium. The intermediate transfer belt 10 is hung around a belt drive roller 11 and a pair of driven rollers 12, 13, to which the drive force of a motor (not shown) is transmitted, and provided rotatably counter-clockwise in FIG. 1. In this case, the belt drive roller 11 and one driven roller 12 are adjacently provided with a predetermined spacing in the direction indicated by an arrow in which a transfer material such as paper to be transported moves. Furthermore, the belt drive roller 11 and the other driven roller 13 are provided apart along the tandem arrangement direction of the respective photoconductors 2Y, 2M, 2C, 2K. In addition, predetermined tension is provided in an arrow direction to the driven roller 13, and the slack of the intermediate transfer belt 10 is removed. Moreover, the movement direction of the intermediate transfer belt 10 can be changed by a pressing roller 63 provided close to the driven roller 12. As shown in FIG. 2, the width of the intermediate transfer belt 10 is narrower than the lengths of the respective photoconductors 2Y, 2M, 2C, 2K.

Figure 3:
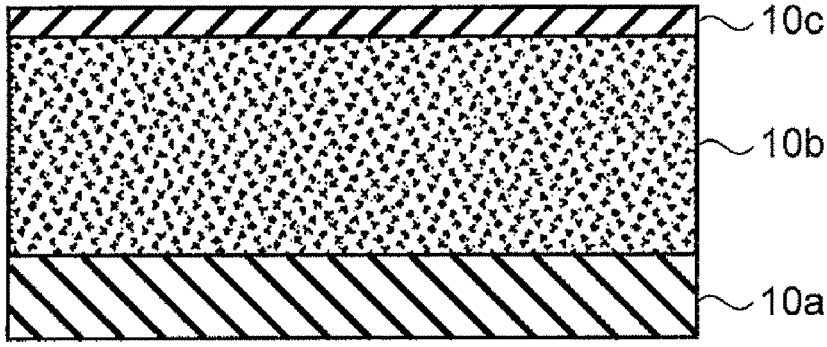
FIG. 3 shows the embodiment of the invention.

As shown in FIG. 3, the intermediate transfer belt 10 has a multilayered structure in which an elastic layer 10*b* is stacked on a base material layer 10*a*, and a coating layer 10*c* is formed on the elastic layer 10*b*. The multilayered structure including the elastic layer provides appropriate elasticity in the thickness direction to the intermediate transfer belt 10, improves the transferability of the liquid developer images from the photoconductors 2Y, 2M, 2C, 2K and the transferability to the transfer material, and thereby, the transferability to the material with great irregularities is especially advantageous and clear images can be transferred onto recessed parts. The base material layer 10*a* is made of polyimide resin, polyamide-imide resin, or the like and has a thickness of about 100 μm. The elastic layer 10*b* is made of polyurethane rubber or the like and has hardness of JIS-A30 and a thickness of 200 μm. The coating layer 10*c* is made of fluorine resin or the like and has a thickness of 10 μm. The thickness of the intermediate transfer belt 10 having the multilayered structure is about 0.3 mm, and the volume resistance value of the intermediate transfer belt 10 is about $10^{-10}$ Ωcm (resistance value of entire layers).

In the image forming apparatus 1 in this example, the respective photoconductors 2Y, 2M, 2C, 2K and the respective developing devices 5Y, 5M, 5C, 5K are provided in the order of the colors Y, M, C, K from the upstream side in the rotational direction of the intermediate transfer belt 10, however, the order of arrangement of these respective colors Y, M, C, K may be arbitrarily set.

At the downstream side of the respective primary transfer devices 7Y, 7M, 7C, 7K in the rotational direction of the intermediate transfer belt 10, intermediate transfer belt squeeze devices 15Y, 15M, 15C, 15K are provided close to the primary transfer devices 7Y, 7M, 7C, 7K, respectively. Further, a secondary transfer device 16 is provided at the belt drive roller 11 side of the intermediate transfer belt 10, and an intermediate transfer belt cleaning device 17 is provided at the driven roller 13 side of the intermediate transfer belt 10.

Though not shown, as is the case of a typical image forming apparatus 1 performing secondary transfer, the image forming apparatus in this example includes a transfer material holding device that holds transfer materials such as paper, for example and a pair of resist rollers that feed the transfer materials from the transfer material holding device to the secondary transfer device 16 at the upstream side of the secondary transfer device 16 in the direction in which the transfer materials are transported. Further, the image forming apparatus 1 includes a fixing device and a paper eject tray at the downstream side of the secondary transfer device 16 in the direction in which the transfer materials are transported.

The respective charging members 3Y, 3M, 3C, 3K each includes a pair of corona chargers, for example. To the respective charging members 3Y, 3M, 3C, 3K, biases having the same polarity as the charge polarity of the liquid developer are applied from a power supply device (not shown), respectively. Further, the respective charging members 3Y, 3M, 3C, 3K charge the corresponding photoconductors 2Y, 2M, 2C, 2K, respectively. Furthermore, the respective exposure devices 4Y, 4M, 4C, 4K form electrostatic latent images on the corresponding charged photoconductors 2Y, 2M, 2C, 2K, respectively, by applying laser beams from a laser scan system or the like, for example.

The respective developing devices 5Y, 5M, 5C, 5K include developer supply units (not shown), developing rollers 19Y, 19M, 19C, 19K, corona chargers for charging toner 20Y, 20M, 20C, 20K, and developing roller cleaners 21Y, 21M, 21C, 21K, respectively.

The respective developer supply units include developer containers containing liquid developers including toner particles and nonvolatile liquid carrier, developer pumping rollers 25Y, 25M, 25C, 25K, anilox rollers 26Y, 26M, 26C, 26K, and developer regulating blades 27Y, 27M, 27C, 27K, respectively.

In the liquid developers contained within the respective developer containers, as the toner, particles having an average particle diameter of 1 μm, for example, formed by dispersing known coloring agents such as pigments in the known thermoplastic resin for toner use may be used. On the other hand, as the liquid carrier, for a liquid developer having low viscosity and low concentration, insulating liquid carrier of Isopar (trademark of Exxon), for example, may be used. Further, as the liquid carrier, for a liquid developer having high viscosity and high concentration, for example, organic solvent, silicone oil having a flash point of 210° C. or more such as phenylmethyl siloxane, dimetyl polysiloxane and polydimetylcyclo siloxane, mineral oil, aliphatic saturated hydrocarbon such as relatively low-viscosity liquid paraffin having a boiling point of 170° C. or more and viscosity at 40° C. of 3 mPa·s, insulating liquid carrier such as normal paraffin, vegetable oil, edible oil, or higher fatty acid ester may be used. Further, liquid developers 23Y, 23M, 23C, 23K are formed by adding toner particles to the liquid carrier with dispersants to have toner solid content concentration of about 20%.

The respective developer pumping rollers 25Y, 25M, 25C, 25K pump up the liquid developers within the respective developer containers and supply the developers to the respective anilox rollers 26Y, 26M, 26C, 26K. All of the respective developer pumping rollers 25Y, 25M, 25C, 25K are adapted to rotate clockwise as indicated by arrows in FIG. 1. Further, all of the respective anilox rollers 26Y, 26M, 26C, 26K are cylindrical members having surfaces on which fine homogeneous spiral grooves are formed. Regarding the dimensions of the grooves, for example, the groove pitch is set to about 170 μm and the groove depth is set to about 30 μm. Obviously, the dimensions of grooves are not limited to the values. All of the respective anilox rollers 26Y, 26M, 26C, 26K are adapted to rotate counter-clockwise in the same direction of the developing rollers 19Y, 19M, 19C, 19K as indicated by arrows in FIG. 1. The respective anilox rollers 26Y, 26M, 26C, 26K may be adapted to rotate as the respective developing rollers 19Y, 19M, 19C, 19K rotate. That is, the rotational directions of the anilox rollers 26Y, 26M, 26C, 26K are not limited but arbitrary.

The respective developer regulating blades 27Y, 27M, 27C, 27K are provided in contact with the surfaces of the respective anilox rollers 26Y, 26M, 26C, 26K. These developer regulating blades 27Y, 27M, 27C, 27K include rubber parts of urethane rubber or the like in contact with the surfaces of the respective anilox rollers 26Y, 2M, 26C, 26K, respectively, and plates of metal for supporting the rubber parts. Further, the respective developer regulating blades 27Y, 27M, 27C, 27K remove the liquid developers attached to the surfaces other than the groove parts of the anilox rollers 26Y, 26M, 26C, 26K by scraping the developers with the rubber parts. Therefore, the respective anilox rollers 26Y, 26M, 26C, 26K supply only the liquid developers attached within the grooves to the respective developing rollers 19Y, 19M, 19C, 19K.

All of the respective developing rollers 19Y, 19M, 19C, 19K are cylindrical members having widths of about 320 mm, for example, and include elastic materials such as conductive urethane rubber, and resin layers and rubber layers on outer circumferential parts of metal shafts of iron or the like, for example. These developing rollers 19Y, 19M, 19C, 19K are adapted to be in contact with the respective photoconductors 2Y, 2M, 2C, 2K and rotate counter-clockwise as indicated by arrows in FIG. 1.

The respective corona chargers for charging toner 20Y, 20M, 20C, 20K are adapted to charge the corresponding developing rollers 19Y, 19M, 19C, 19K when voltages are applied, respectively.

Furthermore, the respective developing roller cleaners 21Y, 21M, 21C, 21K include rubber, for example, in contact with the surfaces of the developing rollers 19Y, 19M, 19C, 19K for removing the developers left on the developing rollers 19Y, 19M, 19C, 19K by scraping them.

The respective photoconductor squeeze devices 6Y, 6M, 6C, 6K include pairs of photoconductor squeeze rollers 36Y, 36M, 36C, 36K and photoconductor squeeze roller cleaners 37Y, 37M, 37C, 37K, respectively. The respective photoconductor squeeze rollers 36Y, 36M, 36C, 36K are provided at the downstream side of the contact parts (nip parts) of the respective photoconductors 2Y, 2M, 2C, 2K and the respective, developing rollers 19Y, 19M, 19C, 19K in the rotational direction of the respective photoconductors 2Y, 2M, 2C, 2K, respectively. Further, these photoconductor squeeze rollers 36Y, 36M, 36C, 36K are adapted to rotate in the opposite direction (counter-clockwise in FIG. 1) to the respective photoconductors 2Y, 2M, 2C, 2K and remove the liquid carrier on the respective photoconductors 2Y, 2M, 2C, 2K, respectively.

As all of the respective photoconductor squeeze rollers 36Y, 36M, 36C, 36K, elastic rollers formed by providing elastic members of conductive urethane rubber or the like and fluorine resin surface layers on surfaces of cores made of a metal. Further, all of the respective photoconductor squeeze roller cleaners 37Y, 37M, 37C, 37K include elastic materials of rubber or the like, are brought into contact with the corresponding photoconductor squeeze rollers 36Y, 36M, 36C, 36K, and remove the liquid carrier left on the squeeze rollers 36Y, 36M, 36C, 36K by scraping it.

The respective primary transfer devices 7Y, 7M, 7C, 7K include backup rollers for primary transfer 39Y, 39M, 39C, 39K that bring the intermediate transfer belt 10 into contact with the respective photoconductors 2Y, 2M, 2C, 2K, respectively. The respective backup rollers 39Y, 39M, 39C, 39K primarily transfer the toner images (liquid developer images) of the respective colors on the respective photoconductors 2Y, 2M, 2C, 2K onto the intermediate transfer belt 10 when voltages of about −200 V, for example, having opposite polarity to the charge polarity of the toner particles are applied thereto.

The respective photoconductor cleaning devices 8Y, 8M, 8C, 8K include photoconductor cleaning rollers 43Y, 43M, 43C, 43K provided on the photoconductors 2Y, 2M, 2C, 2K after primary transfer, photoconductor cleaning roller cleaners 44Y, 44M, 44C, 44K, and photoconductor cleaning blades 45Y, 45M, 45C, 45K.

The respective intermediate transfer belt squeeze devices 15Y, 15M, 15C, 15K include intermediate transfer belt squeeze rollers 40Y, 40M, 40C, 40K, backup roller rollers for squeezing intermediate transfer belts 42Y, 42M, 42C, 42K, and intermediate transfer belt squeeze roller cleaners 41Y, 41M, 41C, 41K. The respective intermediate transfer belt squeeze rollers 40Y, 40M, 40C, 40K collect the liquid carrier of the corresponding colors on the intermediate transfer belt 10, respectively. Further, the respective intermediate transfer belt squeeze roller cleaners 41Y, 41M, 41C, 41K scrape the collected liquid carrier on the intermediate transfer belt squeeze rollers 40Y, 40M, 40C, 40K, respectively. These intermediate transfer belt squeeze roller cleaners 41Y, 41M, 41C, 41K include elastic materials of rubber or the like as is the case of the respective photoconductor squeeze roller cleaners 37Y, 37M, 37C, 37K, respectively.

The intermediate transfer belt cleaning blade 17 provided at the driven roller 13 side of the intermediate transfer belt 10 includes an intermediate transfer belt cleaning roller 50, an intermediate transfer belt cleaning roller cleaner 51, and an intermediate transfer belt cleaning blade 49. When a bias is applied, the intermediate transfer belt cleaning roller 50 removes the solid content on the intermediate transfer belt 10 by electrostatic absorption. The intermediate transfer belt cleaning blade 49 located at the downstream scrapes and removes the residual toner on the intermediate transfer belt 10.

The secondary transfer device 16 includes a pair of secondary transfer rollers provided with a predetermined spacing from each other in the direction in which the transfer materials move. Of the pair of secondary transfer rollers, the secondary transfer roller provided at the upstream side in the direction in which the transfer materials move is the first secondary transfer roller 43. Further, of the pair of secondary transfer rollers, the secondary transfer roller provided at the downstream side in the direction in which the transfer materials move is the second secondary transfer roller 44. An endless transfer belt 46 is hung around the first and second transfer rollers 43, 44. In this case, tension is provided to the transfer belt 46 by a tension roller 61. Furthermore, the first and second transfer rollers 43, 44 can be brought into contact with the belt drive roller 11 and the driven roller 12 via the intermediate transfer belt 10 and the transfer belt 46, respectively. The transfer belt 46 is made of polyimide resin or polyamide-imide resin.

That is, the transfer belt 46 hung around the first and second transfer rollers 43, 44 bring the transfer materials into close contact with the intermediate transfer belt 10 hung around the belt drive roller 11 and the driven roller 12, and secondarily transfers a toner image (liquid developer image) formed by combining toner images of the respective colors on the intermediate transfer belt 10 while transporting the transfer material in close contact with the intermediate transfer belt 10.

In this case, the belt drive roller 11 and the driven roller 12 also function as backup rollers of the first and second transfer rollers 43, 44, respectively. That is, the belt drive roller 11 is also used as the first backup roller provided at the upstream side of the driven roller 12 in the direction in which the transfer materials move in the secondary transfer device 16. Further, the driven roller 12 is also used as the second backup roller provided at the downstream side of the belt drive roller 11 in the direction in which the transfer materials move in the secondary transfer device 16.

Therefore, the transfer material transported to the secondary transfer device 16 is brought into close contact with the intermediate transfer belt 10 in a predetermined movement region of the transfer material from the pressing start position (nip start position) between the first transfer roller 43 and the belt drive roller 11 to the pressing end position (nip end position) between the second transfer roller 44 and the driven roller 12. Thereby, the full-color toner image on the intermediate transfer belt 10 is secondarily transferred onto the transfer material in close contact with the intermediate transfer belt 10 in a predetermined period, and thus, good secondary transfer is performed.

Further, the secondary transfer device 16 includes a transfer belt cleaner 45 for the transfer belt 46. The transfer belt cleaner 45 includes an elastic material of rubber or the like as is the case of the respective photoconductor squeeze roller cleaners 37Y, 37M, 37C, 37K. The transfer belt cleaner 45 is brought into contact with the transfer belt 46 and scrapes and removes foreign materials such as the liquid developers left on the surface of the transfer belt 46 after second transfer. Therefore, the influence on the next transfer material by the foreign materials such as the liquid developers attached to the transfer belt 46 can be prevented.

Furthermore, the first secondary transfer roller 43 can be brought into contact with the belt drive roller 11 via the intermediate transfer belt 10 and the transfer belt 46. Thereby, when the transfer material starts to enter the pressure position between the belt drive roller 11 and the first secondary transfer roller 43 and the transfer material is reliably brought into close contact with the intermediate transfer belt 10. Thereby, transfer of the liquid developer image from the intermediate transfer belt 10 to the transfer material is reliably started. Moreover, the transfer material that has passed through the pressure position between the belt drive roller 11 and the first secondary transfer roller 43 is nipped between the intermediate transfer belt 10 and the transfer belt 46, and thus, separation (floating) of the transfer material from the intermediate transfer belt 10 can be suppressed. Therefore, even better transfer can be performed. In addition, the transfer belt 46 is made in parallel to the intermediate transfer belt 10 between the contact position of the first secondary transfer roller 43 and the belt drive roller 11 and the contact position of the second secondary transfer roller 44 and the driven roller 12. Thereby, the transfer material can be stably in close contact with the intermediate transfer belt 10 while the transfer material moves between these contact positions. Therefore, the transfer efficiency becomes even better and the transportation of transfer materials can be further improved.

When the transfer material starts to enter the pressure part between the belt drive roller 11 and the first secondary transfer roller 43 and the pressure part between the driven roller 12 and the second secondary transfer roller 44, respectively, both the intermediate transfer belt 10 and the transfer belt 46 receive resistance and may become loose. Accordingly, tension is provided to the intermediate transfer belt 10 also using the driven roller 12 as the tension roller, and tension is provided to the transfer belt 47 by providing a tension roller 60. Thereby, if the intermediate transfer belt 10 and the transfer belt 46 receive resistance and may become loose as described above, the intermediate transfer belt 10 and the transfer belt 46 are held in the state of tension. Therefore, the transfer from the intermediate transfer belt 10 to the transfer material can be efficiently performed between the pressure position of the belt drive roller 11 and the first secondary transfer roller 43 and the pressure position of the driven roller 12 and the second secondary transfer roller 44. Additionally, support and transport of the transfer materials by the transfer belt 46 can be more stably and more reliably performed.

The color toner image transferred onto the transfer material is fixed by a fixing unit (not shown) similarly to the case in the related art, the transfer material with the full-color fixed image formed thereon is transported to the paper eject tray, and the color image formation operation is ended.

Figure 4:
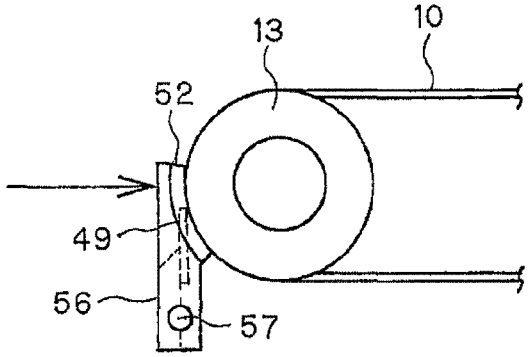
FIG. 4 shows an embodiment of the invention.
Figure 5:
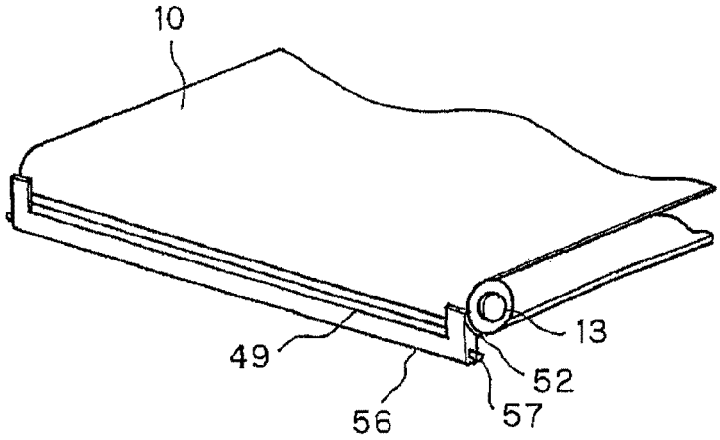
FIG. 5 shows the embodiment of the invention.
Figure 6:
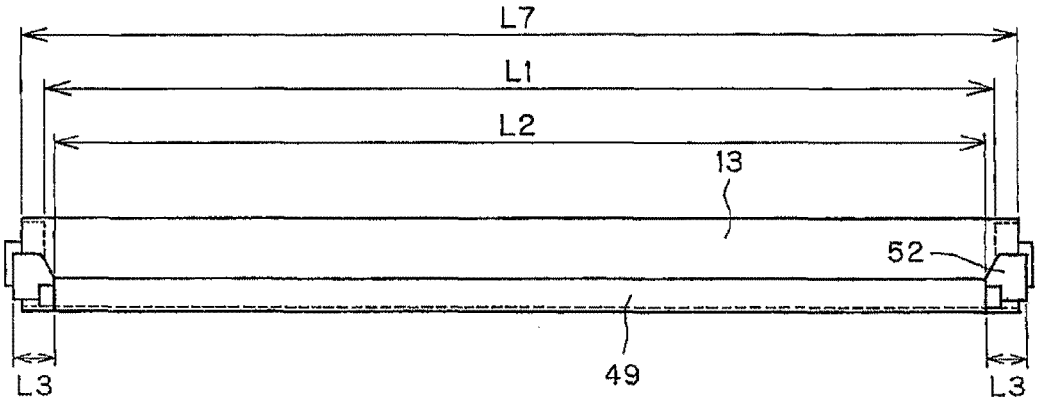
FIG. 6 shows the embodiment of the invention.

FIGS. 4 to 6 show an embodiment of the intermediate transfer belt cleaning device 17. The intermediate transfer belt cleaning device 17 is provided at the driven roller 13 side as the tension roller that provides tension to the intermediate transfer belt 10 for removing the residual liquid developers on the intermediate transfer belt 10 after secondary transfer.

The driven roller 13 around which the intermediate transfer belt 10 is hung has a roller main body formed by providing a nonslip surface layer of urethane rubber around a core metal and having an outer diameter of 33.4 mm and an axial length L1 of 367 mm.

Figure 11:
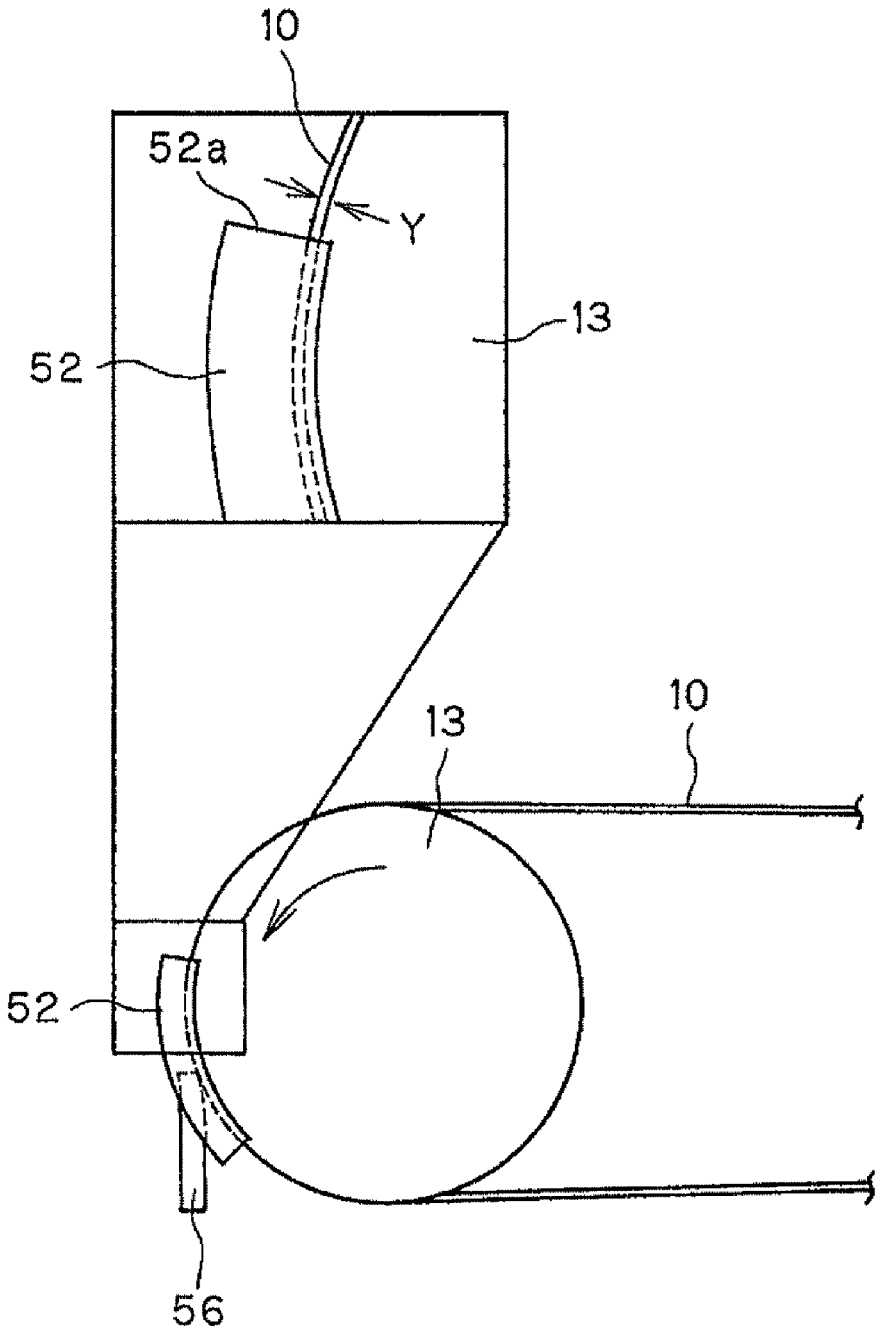
FIG. 11 shows a reference example of the invention.

As shown in FIG. 11 the intermediate transfer belt cleaning device 17 includes the intermediate transfer belt cleaning roller 50 in contact with the driven roller 13 via the intermediate transfer belt 10, the intermediate transfer belt cleaning roller cleaner 51 in contact with the intermediate transfer belt cleaning roller 50, and the intermediate transfer belt cleaning blade 49 in contact via the intermediate transfer belt 10 at the downstream of the intermediate transfer belt cleaning roller 50.

The intermediate transfer belt cleaning roller 50 is formed by wrapping urethane rubber having hardness of JIS-A30 around a core metal in thickness of 2.5 mm and applying urethane coating having hardness of JIS-A60 onto the rubber in thickness of 100 μm, and has a diameter of 25 mm and an axial length L4 of 352 mm. The intermediate transfer belt cleaning roller 50 is driven at the equal speed to that of the intermediate transfer belt 10 in the rotational direction following the belt. A voltage of about 400 V is applied to the intermediate transfer belt cleaning roller 50, and the roller removes the solid content such as toner on the intermediate transfer belt 10 by the electrostatic absorption. The resistance value of the intermediate transfer belt cleaning roller 50 is $10^{-4}\Omega$, for example.

At the downstream of the intermediate transfer belt cleaning roller 50, the intermediate transfer belt cleaning blade 49 in contact with the driven roller 13 via the intermediate transfer belt 10 is provided. Since a lot of solid content of the residual toner is removed by the electrostatic absorption of the intermediate transfer belt cleaning roller 50, the load of cleaning on the intermediate transfer belt cleaning blade 49 in contact with the intermediate transfer belt 10 at the downstream is reduced. The intermediate transfer belt cleaning blade 49 is made of urethane rubber having hardness H2 of JIS-A90 higher than the hardness H1 of the intermediate transfer belt 10, and has a thickness of 2 mm, a free length of 6.5 mm, and an axial length L6 of 351 mm. The intermediate transfer belt cleaning blade 49 is in contact in the counter direction to the rotational direction of the intermediate transfer belt 10. The contact angle is not specifically limited. When the blade is brought into contact at the contact angle of 20 degrees at contact pressure of 1.2 kgf, a good cleaning property is obtained.

As shown in FIG. 2, since the axial lengths L8 of the respective photoconductors 2Y, 2M, 2C, 2K are longer than the width L7 of the intermediate transfer belt 10 in the axial direction of the photoconductors, cleaning of both ends of the intermediate transfer belt 10 after secondary transfer is important for preventing the color contamination. Further, the liquid developers scraped off by the intermediate transfer belt cleaning blade 49 flow along the surface of the intermediate transfer belt cleaning blade 49 and is collected and the liquid developer accumulated in the contact part between the cleaning blade and the transfer belt surface spreads to the ends of the cleaning blade due to capillary action, and thus, a problem that a band of liquid called a liquid ring is generated and causes image defects such as color contamination arises.

Accordingly, transfer belt sealing members 52 are attached to both axial ends of the intermediate transfer belt cleaning blade 49. The transfer belt sealing members 52 use PORON ML-32 (having hardness less than 10 in JIS-A) manufactured by INOAC. The transfer belt sealing members 52 have a function as cleaning members for the ends of the intermediate transfer belt 10 and has functions as end sealing members for improving the absorption of the carrier at both ends of the intermediate transfer belt cleaning blade 49 by forming the transfer belt sealing members 52 as oil absorbent members. The transfer belt sealing members 52 have axial lengths L3 of 15 mm and thicknesses of 3 mm.

The intermediate transfer belt cleaning blade 49 and the transfer belt sealing members 52 are supported by a supporting member 56 made of a metal. The supporting member 56 is rotatably pivoted by a pin 57 away from or into contact with the intermediate transfer belt 10. Further, urging means (not shown) such as a spring is provided to the cleaning supporting member 56, and presses the intermediate transfer belt cleaning blade 49 and the transfer belt sealing members 52 against the surface of the intermediate transfer belt.

Figure 7A:
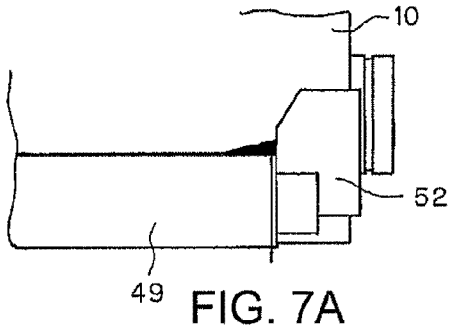
FIGS. 7A and 7B show an embodiment of the invention.
Figure 7B:
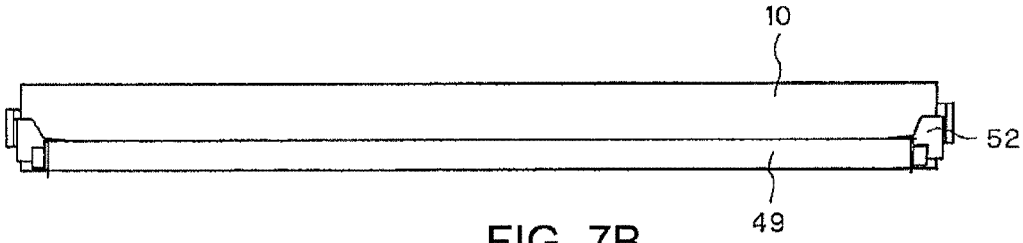
Figure 8A:
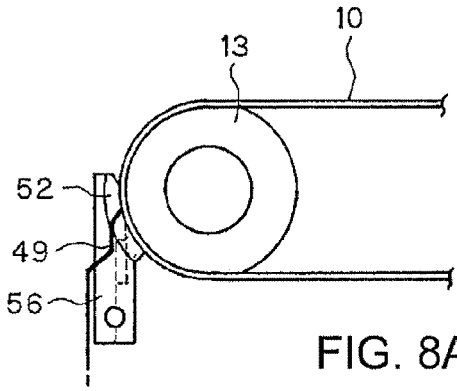
FIGS. 8A and 8B show an embodiment of the invention.
Figure 8B:
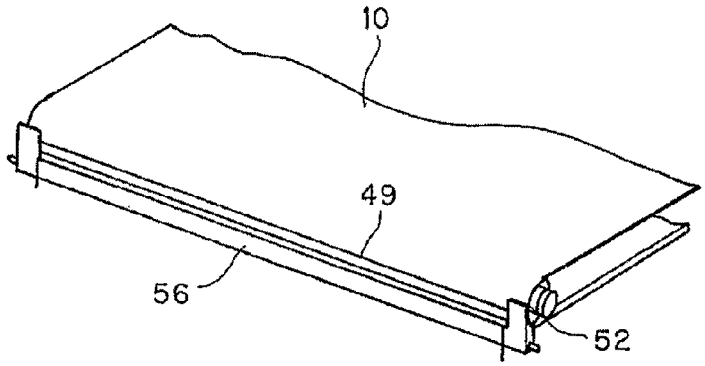

FIGS. 7A and 7B, 8A and 8B show functions of the transfer belt sealing members 52. FIGS. 7A and 7B show a state in which the intermediate transfer belt cleaning blade 49 and the transfer belt sealing members 52 at both ends are in contact with the intermediate transfer belt without the supporting member. FIGS. 8A and 8B show a state in which the intermediate transfer belt cleaning blade 49 and the transfer belt sealing members 52 at both ends are supported by the supporting member 56 in contact with the intermediate transfer belt. In both cases, the liquid developer accumulated in the contact part between the intermediate transfer belt cleaning blade 49 and the intermediate transfer belt 10 surface spreads to the ends of the intermediate transfer belt cleaning blade 49 due to capillary action and a band of liquid called a liquid ring is generated. However, the transfer belt sealing members 52 exert the function as the sealing members for preventing the flow of the liquid developer into the end sides of the intermediate transfer belt 10 and prevent the liquid developer from running around to the rear side of the intermediate transfer belt 10.

The axial length L2 of the intermediate transfer belt cleaning blade 49, the axial length L1 of the driven roller 13, the axial width L7 of the intermediate transfer belt 10, and the axial length L3 of the transfer belt sealing member 52 have relationships of L1>L2, L1<L2+2L3, L7>L1, L7>L2, L7<L2+2L3. Since L1>L2, the intermediate transfer belt cleaning blade 49 can be strongly pressed against the intermediate transfer belt 10 with the driven roller 13 as the backup roller, and the cleaning efficiency can be improved. Further, since L7>L1, L7>L2, L7<L2+2L3, the liquid ring at the ends of the intermediate transfer belt cleaning blade 49 can be prevented from flowing into the ends of the intermediate transfer belt 10, the carrier can be prevented from running around the rear side of the intermediate transfer belt 10, and color contamination can be prevented.

The lengths and widths of the members forming the intermediate transfer belt cleaning device 17 of the invention are shown in the following table 1.

TABLE 1

| Name of member | Axial length or width |
|---|---|
| Driven roller: L1 | 367 mm |
| Intermediate transfer belt cleaning blade: L2 | 351 mm |
| Cleaning blade sealing member: L3 | 15 mm |
| Intermediate transfer belt: L7 | 374 mm |

The hardness H1 of the intermediate transfer belt 10, the hardness H2 of the intermediate transfer belt cleaning blade 49, and the hardness H3 of the transfer belt sealing members 52 have relationships of H2>H1, H1>H3. The intermediate transfer belt cleaning blade 49 blade-cleans the surface of the intermediate transfer belt 10. The transfer belt sealing members 52 clean the surface of both ends of the intermediate transfer belt, while they are pressed and the seal members themselves deform and bite into close contact with both ends of the intermediate transfer belt 10 without the backup roller, and thereby, prevent the leak.

Figure 9:
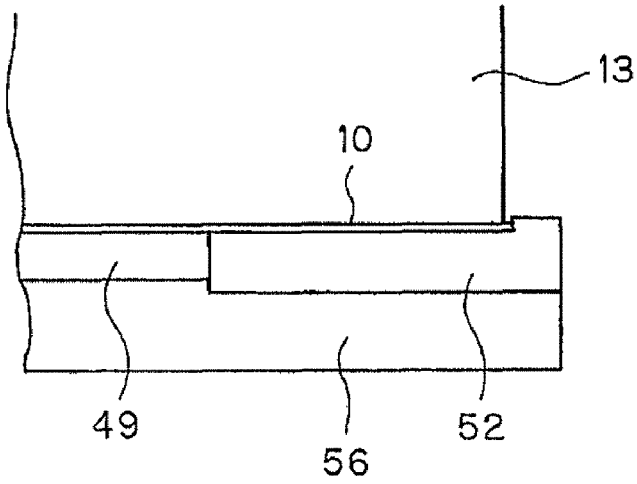
FIG. 9 shows an embodiment of the invention.
Figure 10:
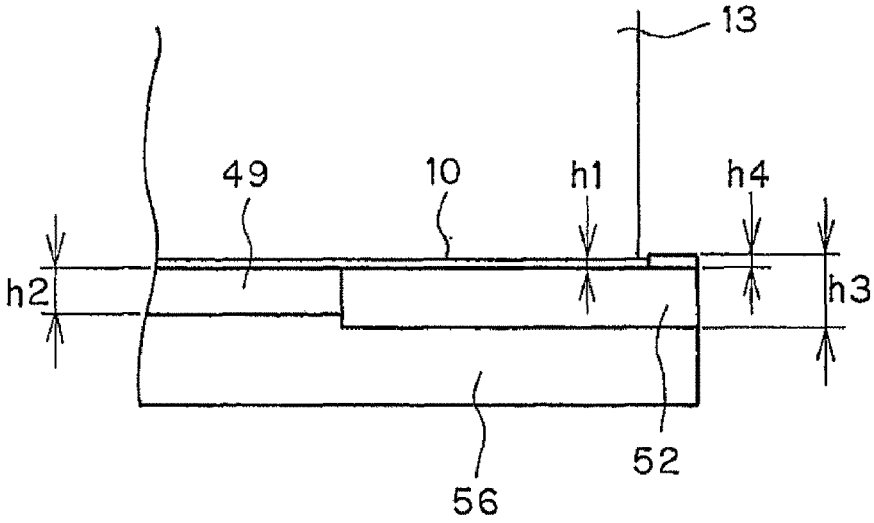
FIG. 10 shows the embodiment of the invention.

FIGS. 9 and 10 are partially enlarged views of the intermediate transfer belt cleaning blade 49 and the transfer belt sealing members 52. The intermediate transfer belt cleaning blade 49 and the transfer belt sealing members 52 supported by the supporting member 56 are pressed against the intermediate transfer belt 10 because the supporting member 56 is urged in the contact direction of the intermediate transfer belt 10 by urging means (not shown). Since the hardness H3 of the transfer belt sealing members 52 is smaller than the hardness H1 of the intermediate transfer belt 10, the parts in contact with the surface of the intermediate transfer belt 10 are compressed and deformed. On the other hand, the parts of the transfer belt sealing members 52 not in contact with the intermediate transfer belt 10 are not compressed or deformed and brought into contact with ends of the intermediate transfer belt 10.

As shown in FIG. 10, under the condition that the thickness h2 of the intermediate transfer belt cleaning blade 49 is 2 mm, the thickness h3 of the transfer belt sealing members 52 is 3 mm, and the thickness h1 of the intermediate transfer belt having the multilayered structure is 0.3 mm, the intermediate transfer belt cleaning blade 49 and the transfer belt sealing members 52 are pressed against the intermediate transfer belt 10 by the supporting member 56. Since the hardness H2 of the intermediate transfer belt cleaning blade is higher than the hardness H1 of the intermediate transfer belt 10, the thickness h2 thereof does not change when pressed. Since the hardness H3 of the transfer belt sealing members 52 is lower than the hardness H1 of the intermediate transfer belt 10, the thickness thereof is compressed and deformed from 3 mm to 2.5 mm when pressed against the intermediate transfer belt 10. The parts of the transfer belt sealing members 52 not in contact with the intermediate transfer belt 10 are not compressed or deformed, and the thickness thereof remains 3 mm. As a result, the biting thicknesses h4 of the transfer belt sealing members 52 at both ends of the intermediate transfer belt 10 become 0.5 mm, and the transfer belt sealing members 52 contact the ends of the intermediate transfer belt 10 and prevent the liquid developer from running around from the ends of the intermediate transfer belt 10 to the rear side.

FIG. 11 shows a reference example showing the contact state of the transfer belt sealing members 52 with the ends of the intermediate transfer belt 10. The leading end surface 52*a* of the transfer belt sealing member 52 contact the end surface of the intermediate transfer belt 10 orthogonally to the thickness direction Y of the intermediate transfer belt 10. When the transfer belt sealing member 52 contacts the end surface of the intermediate transfer belt 10 in this state, the frictional force between the end surface of the intermediate transfer belt 10 and itself is great and a problem that the transfer belt sealing member 52 is entangled with the intermediate transfer belt 10 due to friction and damaged arises. Especially, using the intermediate transfer belt 10 including the elastic layer, the coefficient of friction of the end surface of the intermediate transfer belt 10 is great, and the possibility that the transfer belt sealing member 52 is entangled with the intermediate transfer belt 10 and damaged becomes higher.

Figure 12:
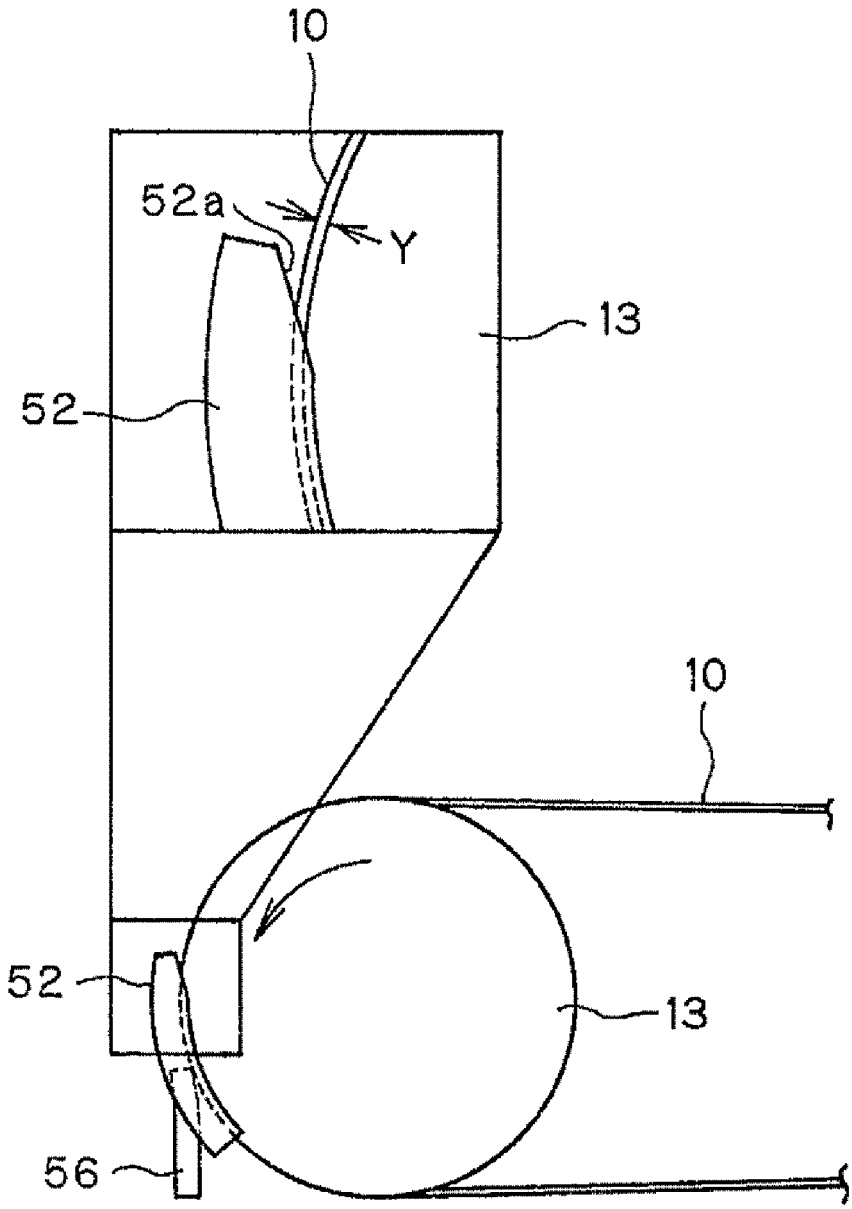
FIG. 12 shows an embodiment of the invention.

FIG. 12 shows a first embodiment of the transfer belt sealing member 52 for preventing entanglement of the transfer belt sealing member 52 with the intermediate transfer belt 10.

In the first embodiment, the leading end surface 52*a* of the transfer belt sealing member 52 is a downwardly inclined surface from the upstream side toward the downstream side in the movement direction of the intermediate transfer belt 10. As a result, the transfer belt sealing member 52 is in contact with inclination relative to the thickness direction Y of the intermediate transfer belt 10 in the contact part between the transfer belt sealing member 52 and the end surface of the intermediate transfer belt 10. The leading end surface 52*a* of the transfer belt sealing member 52 and the end surface of the intermediate transfer belt 10 are in contact with inclination relative to the thickness direction Y of the intermediate transfer belt 10, and therefore, the frictional force between the transfer belt sealing member 52 and the intermediate transfer belt 10 is reduced and the entanglement of the transfer belt sealing member 52 with the intermediate transfer belt 10 can be prevented.

By inclining the leading end surface 52*a* in the contact part between the transfer belt sealing member 52 and the end surface of the intermediate transfer belt 10, in the contact part between the transfer belt sealing member 52 and the surface of the intermediate transfer belt 10, foreign materials or the like on the intermediate transfer belt 10 can be prevented from being buried between the lower surface of the transfer belt sealing member 52 and the surface of the intermediate transfer belt 10.

Figure 13:
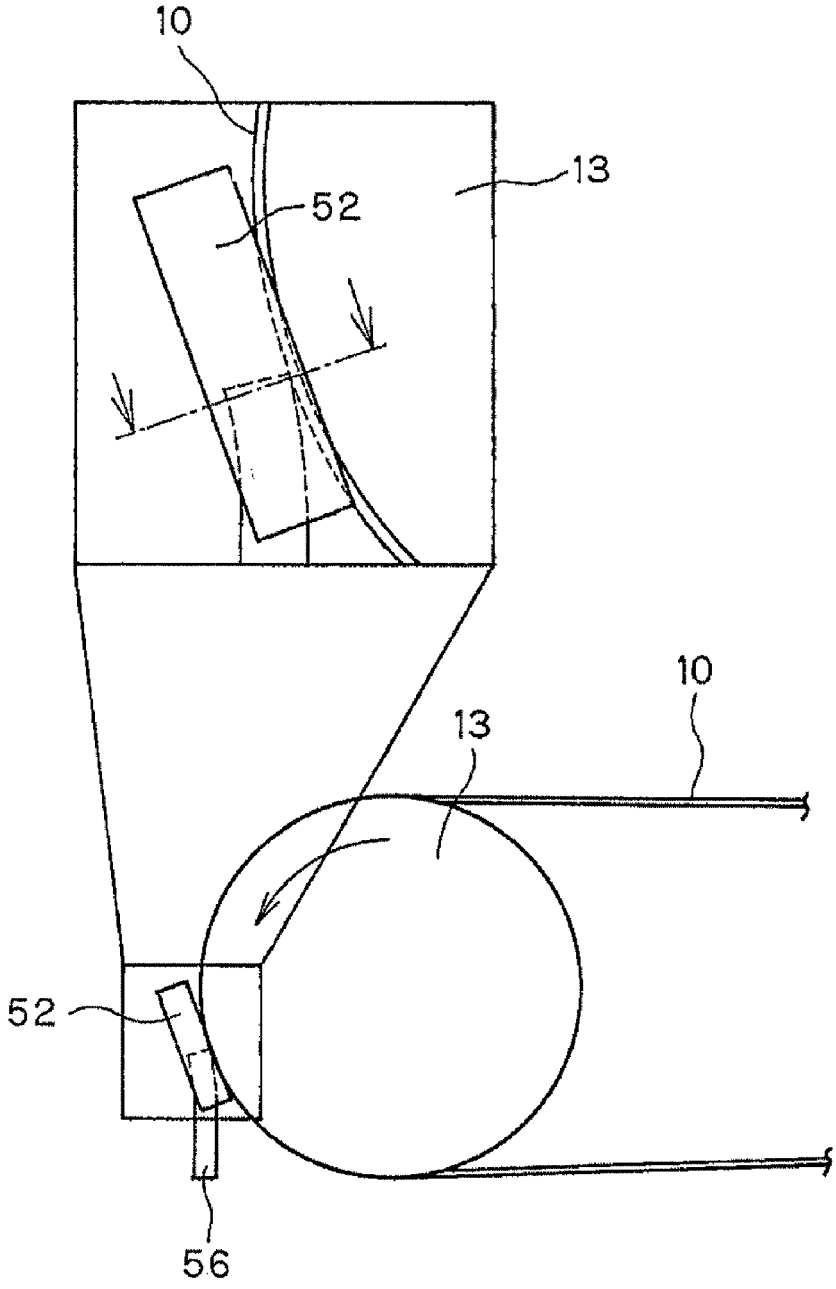
FIG. 13 shows an embodiment of the invention.

FIG. 13 shows a second embodiment of the transfer belt sealing member 52 for preventing entanglement of the transfer belt sealing member 52 with the intermediate transfer belt 10.

In the second embodiment, the transfer belt sealing member 52 is formed in a plate-like shape. The flat part of the plate-like transfer belt sealing member 52 is brought into contact (surface contact) with the curved intermediate transfer belt 10 hung around the driven roller 13. As a result, the transfer belt sealing member contacts the end surface of the intermediate transfer belt diagonally relative to the thickness direction of the transfer belt, and the transfer belt sealing member is prevented from entangled with the intermediate transfer belt and damaged.

Japanese Patent Application Nos. 2008-34551 filed on Feb. 15, 2008 and 2008-259374 filed on Oct. 6, 2008 are hereby incorporated by reference in its entirety.

What is claimed is:

1. A transfer device comprising:

a transfer belt hung around a roller; and a transfer belt sealing member in contact with a transfer surface and a circumferential end surface of the transfer belt and in contact with the circumferential end surface of the transfer belt diagonally relative to a thickness direction of the transfer belt, wherein hardness H1 of the transfer belt and hardness H3 of the transfer belt sealing member has a relationship of H1>H3.

2. The transfer device according to claim 1, wherein the transfer belt sealing member is supported by a supporting member for urging in the thickness direction of the transfer belt.

3. The transfer device according to claim 1, wherein an end surface of a contact part of the transfer belt sealing member with the transfer belt in a transport direction of the transfer belt is an inclined surface.

4. The transfer device according to claim 1, wherein a flat part of the transfer belt sealing member is brought into contact with the transfer surface of the transfer belt.

5. The transfer device according to claim 1, further comprising a transfer belt cleaning blade in contact with the roller via the transfer belt, wherein the transfer belt sealing member is provided at an axial end of the transfer belt cleaning blade.

6. The transfer device according to claim 5, wherein the supporting member supports the transfer belt cleaning blade.

7. A transfer device comprising:

a transfer belt hung around a roller;

a transfer belt sealing member in contact with a transfer surface and a circumferential end surface of the transfer belt and in contact with the circumferential end surface of the transfer belt diagonally relative to a thickness direction of the transfer belt; and a transfer belt cleaning blade in contact with the roller via the transfer belt, wherein the transfer belt sealing member is provided at an axial end of the transfer belt cleaning blade, and a width L7 of the roller in an axial direction, a length L2 of the transfer belt cleaning blade in the axial direction of the roller, and a length L3 of the transfer belt sealing member in the axial direction of the roller have relationships of $$L7>L2,\ L7<L2+2L3.$$

8. An image forming apparatus comprising:

an image carrier;

a developing unit that develops the image carrier with a liquid developer containing toner and carrier liquid;

a transfer belt onto which an image on the image carrier that has been developed by the developing unit is transferred;

a transfer unit that transfers the image that has been transferred onto the transfer belt onto a transfer material;

a roller around which the transfer belt is hung;

a transfer belt cleaning blade in contact with the roller via the transfer belt; and a transfer belt sealing member provided at an end of the transfer belt cleaning blade in an axial direction of the roller, in contact with a transfer surface and a circumferential end surface of the transfer belt and in contact with the circumferential end surface of the transfer belt diagonally relative to a thickness direction of the transfer belt, wherein a length L8 of the image carrier in the axial direction of the roller, a width L7 of the roller in the axial direction, a length L2 of the transfer belt cleaning blade in the axial direction, a length L3 of the transfer belt sealing member in the axial direction of the roller, provided at an end of the transfer belt cleaning blade in the axial direction have relationships of $$L8>L7,\ L7>L2,\ L7<L2+2L3.$$

9. The image forming apparatus according to claim 8, wherein the transfer belt cleaning blade and the transfer belt sealing member are supported by a supporting member for urging in a contact direction of the transfer belt.

10. The image forming apparatus according to claim 8, wherein an end of a contact part of the transfer belt sealing member with the transfer surface of the transfer belt is an inclined surface.

11. The image forming apparatus according to claim 8, wherein a flat part of the transfer belt sealing member is brought into contact with the transfer surface of the transfer belt.

* * * * *